US005145114A

United States Patent [19]

Mönch

[11] Patent Number: 5,145,114

[45] Date of Patent: Sep. 8, 1992

[54] SPRAY HEAD FOR A SINK FAUCET OR THE LIKE

[75] Inventor: Heinrich Mönch, Wie Postanschrift, Fed. Rep. of Germany

[73] Assignee: Ideal-Standard GmbH, Bonn, Fed. Rep. of Germany

[21] Appl. No.: 585,116

[22] PCT Filed: Jan. 24, 1990

[86] PCT No.: PCT/EP90/00132

§ 371 Date: Nov. 26, 1990

§ 102(e) Date: Nov. 26, 1990

[87] PCT Pub. No.: WO90/08598

PCT Pub. Date: Aug. 9, 1990

[30] Foreign Application Priority Data

Jan. 28, 1989 [DE] Fed. Rep. of Germany ..... 3902588

[51] Int. Cl.[5] ..... B05B 1/18

[52] U.S. Cl. ..... 239/126; 239/447; 239/449

[58] Field of Search ..... 251/325; 137/625.49; 239/447, 449, 445, 443, 446, 448, 124, 126

[56] References Cited

U.S. PATENT DOCUMENTS

| | | | |
|---|---|---|---|
| 165,111 | 6/1875 | Miller | 239/449 |
| 2,329,087 | 9/1943 | Russell | 137/625.49 X |
| 4,221,337 | 9/1980 | Shames et al. | 239/447 X |
| 4,629,124 | 12/1986 | Gruber | 239/447 |

*Primary Examiner*—Andres Kashnikow
*Assistant Examiner*—Kevin Weldon
*Attorney, Agent, or Firm*—Sixbey, Friedman, Leedom & Ferguson

[57] ABSTRACT

A spray head (1) for a sink faucet (2) or the like that is suited for connection to a low-pressure storage tank (open hot water storage tank), with a water feed (4), a normal jet discharge (7) placed centrally in particular, a spray discharge (9) placed in particular surrounding normal jet discharge (7) concentrically and with a multiplicity of small spray holes (10), and a reversing valve (13) in which, in the normal position, reversing valve (13) connects normal jet discharge (7) to water feed (4) and separates spray discharge (9) from water feed (4) and, in a spray position, connects spray discharge (9) to water feed (4) and separates normal jet discharge (7) from water feed (4), is completely suited for use in connection with a low-pressure storage tank by a bypass pipe (21) that acts in the spray position being provided in reversing valve (13) between water feed (4) and normal jet discharge (7) and the flow resistance of bypass pipe (21) being greater than the flow resistance of spray discharge (9) when spray holes (10) are not added, but the operationally maximum dynamic pressure occurring upstream from bypass pipe (21) when spray holes (10) are added being smaller than the bursting pressure of an allocated low-pressure storage tank.

4 Claims, 2 Drawing Sheets

SPRAY HEAD FOR A SINK FAUCET OR THE LIKE

BACKGROUND AND SUMMARY OF THE INVENTION

The invention relates to a spray head for a sink faucet or the like that is suited for connection to a low-pressure storage tank (open hot-water storage tank), with a water feed, a normal jet discharge placed centrally in particular, a spray discharge placed in particular concentrically surrounding the normal jet discharge and having a multiplicity of small spray holes and a reversing valve, and in a normal position the reversing valve connects the normal jet discharge to the water feed and separates the spray discharge from the water feed and, in a spray position, connects the spray discharge to the water feed and separates the normal jet discharge from the water feed.

The known spray head on which the invention is based (IDEAL-STANDARD brochure "CERAMIX COMBI" W 538 2 S) is intended and suitable especially for a sink faucet, but a corresponding design of a spray head can also be used for other faucets, especially mixing faucets. It is essential here for such a spray head that it make operation possible with two types of jets namely, on the one hand, with a normal jet, on the other hand, with a spray jet. The normal jet exits at a normal jet discharge through a usual aerator or the like. On the other hand, the spray jet exits through a multiplicity of small spray holes of a spray discharge. In most cases, spray holes of the spray discharge are placed concentrically around the normal jet discharge.

If a known spray head explained above is connected to a central cold water storage and/or a warm water storage, there are no big connection problems. The same applies for connection to a flow heater. But with connection to a low-pressure storage tank, i.e., an open hot water storage tank, attention must be paid that the pressure in the low-pressure storage tank not rise at any time so high that a rupturing of the low-pressure storage tank is to be feared. The rupturing problem addressed here has become generally recognized for single-lever mixers and has lead to operation with permanently installed flow controls that keep the water flow constant even if the water pressure changes.

Regardless of the application of measures known in the art for preventing the rupturing of a low-pressure storage tank, it has turned out that with the use of the known spray head a danger of rupturing still exists when, with maximum flow rate of the water, the normal position is switched to the spray position. This rupturing problem peculiar to this spray head needs a solution, thus the teaching of the invention is based on the object of indicating a spray head fully suited for use in connection with a low-pressure storage tank.

The object indicated above is achieved in the spray head on which the invention is based in that a bypass pipe that operates in the spray position is placed in the reversing valve between the water feed and the normal jet discharge and in that the flow resistance of the bypass pipe is greater than the flow resistance of the spray discharge when the spray holes are not clogged, but the operationally maximum dynamic pressure produced upstream from the bypass pipe when the spray holes are clogged is smaller than the bursting pressure of an allocated low-pressure storage tank. Of course, because of the configuration according to the invention, such a spray head is completely suitable for connection to a low-pressure storage tank, but it can also likewise be used with sink faucets or the like connected in other ways. A first part of the invention lies in the recognition that the rupturing of a low-pressure storage tank during the above-explained switching to a spray head of the type in question can occur if the spray holes of the spray discharge are clogged completely or mostly by dirt or calcium deposits. On switching from the normal position with low flow resistance into the spray position, in this case there is a strong pressure impact, since the water flow is in effect suddenly blocked. Whether or not such a situation occurs can no longer be influenced by the manufacturer but rather depends only on the care with which the user keeps the spray holes of the spray discharge open. In view of the actual desire to achieve an effective switching between normal position and spray position, as a second part of the invention a further flow path has now been created for the spray position, a path that is always open and that can hardly be clogged normally with dirt or calcium deposits. By matching the flow resistance of this bypass pipe to the flow resistance of the spray discharge when the spray holes are not clogged, it is achieved according to the invention that, at most, a limited leak flow normally flows through the bypass pipe into the normal jet discharge. Even if it were to occur, this leak flow is not disturbing in practice. But on switching from the normal position into the spray position when the spray holes are clogged, the bypass pipe assumes entirely or to a large extent, from a flow viewpoint, the function of the spray discharge, even though, because of the higher flow resistance, at a higher pressure level than when the spray holes are not clogged. The flow resistance of the bypass pipe here is measured so that a pressure impact that can become dangerous, pressure-wise, for the low-pressure storage tank cannot occur.

Now there are various possibilities of configuring and further developing the teaching of the invention, for which purpose the following explanation of an embodiment based on the drawing can be referred to. In the drawing there are shown in:

DETAILED DESCRIPTION OF THE PREFERRED EMBODIMENT

Figure 1:
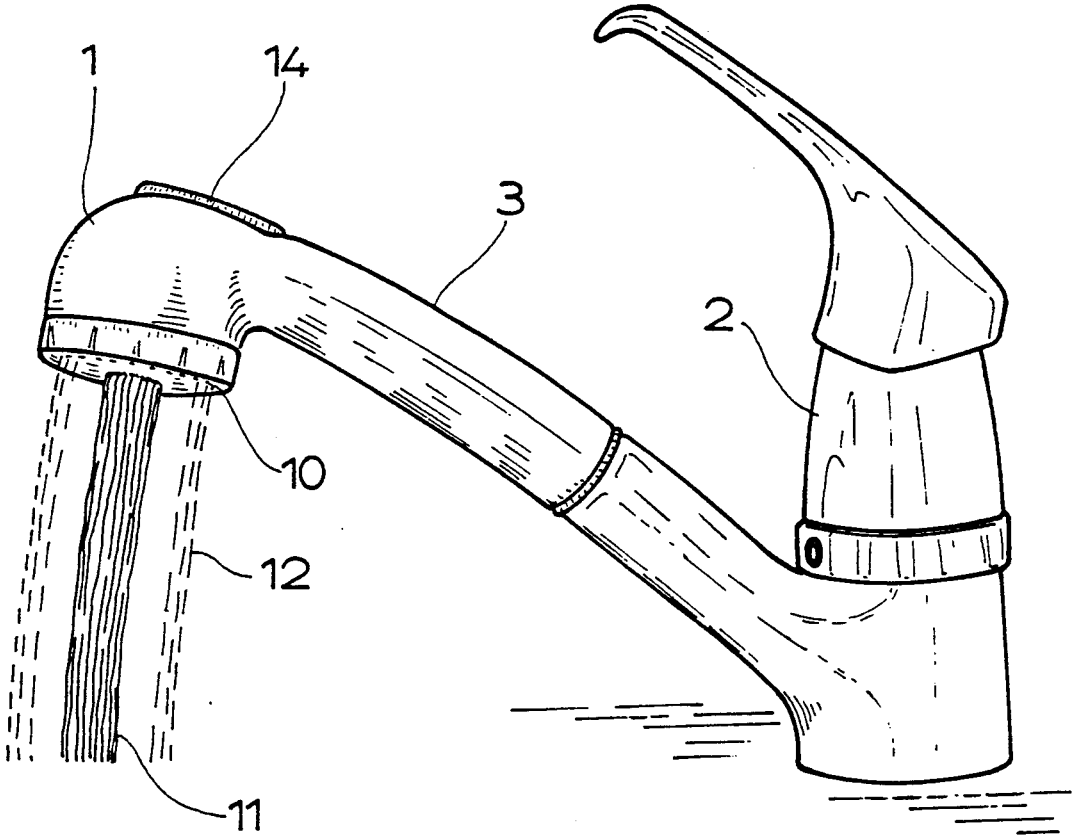
FIG. 1, shows in perspective view, a sink faucet with spray head attached to it
Figure 2:
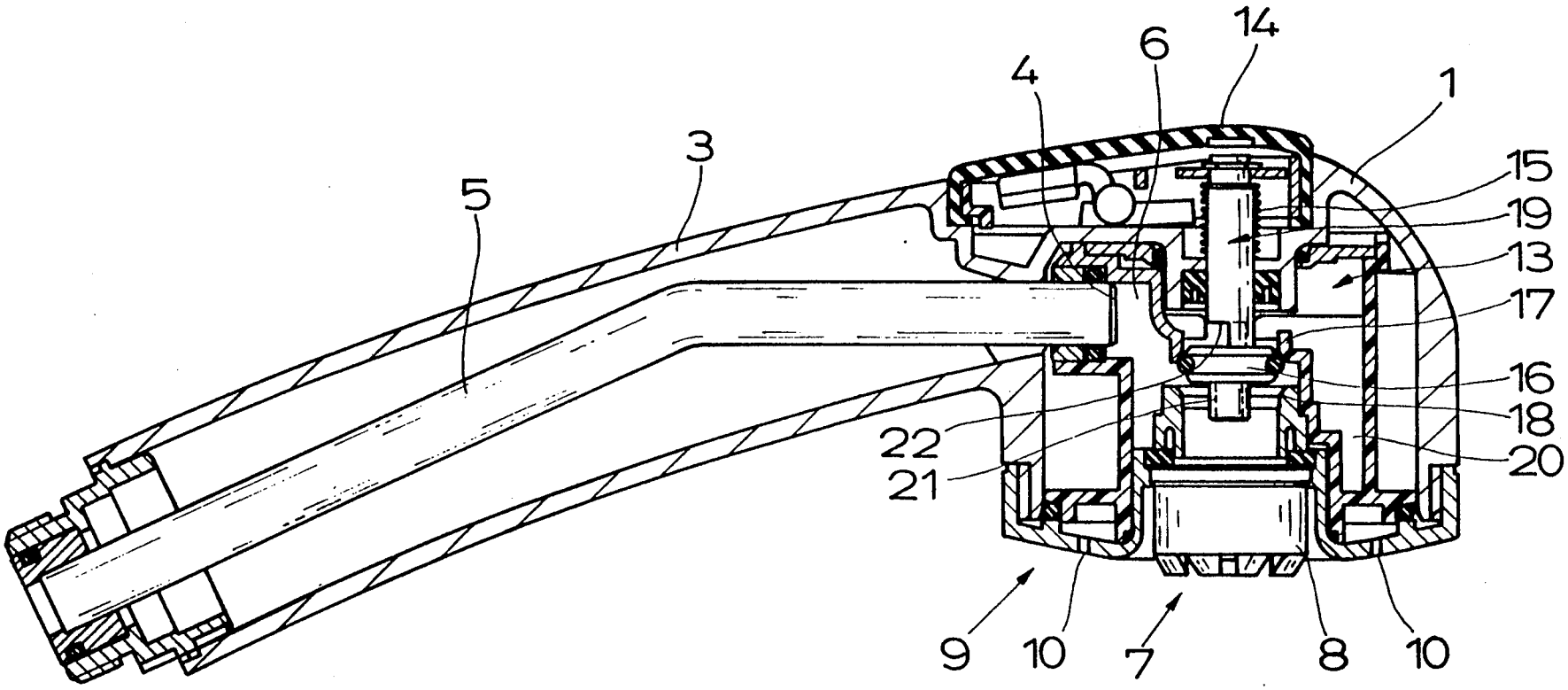
FIG. 2, shows the spray head of FIG. 1 in a section.

Spray head 1 represented in FIGS. 1 and 2 is intended and suited for a sink faucet 2 that can be a mixing faucet, in particular a single-lever mixer, as represented, but that can also be a purely cold water or a purely warm water faucet. Such a spray head can also be used for other fittings, in particular other mixing faucets. Spray head 1, as can be seen in FIG. 1, has a handle 3 by which this spray head 1 can be manipulated. A hose not able to be seen here and running into the interior of sink faucet 2 connects to handle 3 so that spray head 1 can be manipulated relatively freely.

As has already been explained in the general part of the description, spray head 1 according to the invention is intended and suited for a sink faucet 2 or the like that is to be suited in particular for connection to a low-pressure storage tank (open hot water storage tank). The problem on which the teaching is based is posed in connection with a low-pressure storage tank. However, a spray head 1 according to the invention can also be used in connection with other water feed systems.

As can be seen in FIG. 2, spray head 1 also comprises a water feed 4 that receives water by a feed pipe 5 in handle 3 from a hose not represented or from another connection. Water feed 4 empties into a receiving chamber 6 in spray head 1 to which a normal jet discharge 7 placed approximately centrally in spray head 1 connects. A common aerator 8 is placed downstream from normal jet discharge 7 here. In the embodiment represented here, a spray discharge 9, with a multiplicity of small spray holes 10 that can also be seen in FIG. 1, surrounds normal jet discharge 7 concentrically. FIG. 1 makes it clear here that this spray head 1 can be switched from operation with normal jet 11 to operation with spray jet 12. A reversing valve 13 that can now be seen clearly again in FIG. 2 is used for this switching. In a normal position, reversing valve 13 connects normal jet discharge 7 to water feed 4 and separates spray discharge 9 from water feed 4. FIG. 2 also shows this position. In contrast, in a spray position, reversing valve 13 connects spray discharge 9 with water feed 4 and separates normal jet discharge 7.

A push button 14, made as a waterproof seal on the top of spray head 1, is used to operate reversing valve 13, a push button that can lower a valve body 16 in an axial direction against the spring tension of a spring element 15 when this push button 14 is pressed down. In the embodiment represented in FIG. 2, in the normal position, valve body 16 is in sealing contact against an upper valve seat 17 so that receiving chamber 6 is connected directly to normal jet discharge 7. If push button 14 is pressed down, valve body 16 is pushed downward against the action of spring element 15, thus is lifted off valve seat 17 and brought to lie tightly against valve seat 18. Further, valve body 16 here sits annularly on a piston rod 19 that can be moved axially by push button 14. But that is only one possible embodiment for such a reversing valve 13.

In the functional position explained secondly above, which is not represented in FIG. 2, reversing valve 13 is in the spray position in which receiving chamber 6 is connected directly to a spray chamber 20 which, for its part, is connected to spray discharge 9.

Basically it is naturally to be sought, and it is also achieved in spray head 1 on which the invention is based, that all water flowing through water feed 4 flows in the normal position through normal jet discharge 7 and, in the spray position, through spray holes 10 of spray discharge 9. Therefore, reversing valve 13 must act in this regard as a real reversing valve. To achieve the desired protection against rupturing for a low-pressure storage tank, the invention deviates slightly from this basic concept realized in the prior art. According to the invention it is namely so that a bypass pipe 21, which operates in the spray position, is provided in reversing valve 13 between water feed 4 and normal jet discharge 7 and that the flow resistance of bypass pipe 21 is greater than the flow resistance of spray discharge 9 when spray holes 10 are not clogged, but the operationally maximum dynamic pressure occurring upstream from bypass pipe 21 when spray holes 10 are clogged is smaller than the bursting pressure of an allocated low-pressure storage tank. The advantages explained above are achieved in this way.

Because of the way bypass pipe 21 is integrated in detail in reversing valve 13, a multiplicity of variations is possible. For example, bypass pipe 21 can be placed to some degree parallel to reversing valve 13. But in the embodiment represented and thus preferred, bypass pipe 21 is placed in valve body 16 of reversing valve 13. That is represented here in dashed lines. This integrated configuration has the advantage that the design of known spray head 1, as such, can be left completely unchanged and only valve body 16 must be replaced to achieve spray head 1 according to the invention.

As has already been explained above, valve body 16 of spray head 1 according to the invention involves, in the embodiment represented here, a seat valve body that can be moved in an axial direction in a way known in the art. Now it is true here that bypass pipe 21 is made as a central, axial channel in valve body 16. Actually the configuration here is such that valve body 16 is placed on a piston rod 19 exhibiting the central, axial channel and piston rod 19 is open on its face on the end facing normal jet discharge 7 and exhibits, on the side facing spray discharge 9, a lateral inlet opening 22 for the channel forming bypass pipe 21 or a part of the bypass pipe.

The teaching of the invention contains the measure of configuring the flow resistance of bypass pipe 21 so that the operationally maximum dynamic pressure occurring upstream from bypass pipe 21 is smaller than the bursting pressure of an allocated low-pressure storage tank. A matching of different bursting pressures is performed in an especially simple way in that an insert that limits the effective flow resistance is inserted, able to be replaced, in the bypass pipe.

In the embodiment represented here and preferred, bypass pipe 21 is always open so that the above-mentioned limited leak flow can be produced. A more complicated method which, however, precludes this leak flow with certainty when spray holes 10 are not clogged, consists in placing a valve whose opening is pressure controlled in bypass pipe 21. That is not represented here.

I claim:

1. Spray head (1) for a sink faucet (2) for connection to a low-pressure storage tank, said spray head comprising a water feed (4), a normal jet discharge (7), a spray discharge (9) concentrically surrounding the normal jet discharge (7) and having a multiplicity of small spray holes (10), and a reversing valve (13) wherein, in a normal position, the reversing valve (13) connects the normal jet discharge (7) to the water feed (4) and separates the spray discharge (9) from the water feed (4) and, in a spray position, connects the spray discharge (9) to the water feed (4) and blocks water flow to normal jet discharge (7) from the water feed (4), wherein a bypass pipe (21) that is active in the spray position is provided in the reversing valve for providing a flow path between the water feed (4) and the normal jet discharge (7), and wherein the flow resistance of bypass pipe (21) is greater than the flow resistance of the spray discharge (9) when the spray holes (10) are not clogged for achieving a preferential flow to a spray discharge but which is low enough to permit a flow through the bypass during operation of the spray head when the spray holes are clogged to limit a maximum dynamic pressure occurring upstream from the bypass pipe (21) to a value which is smaller than the bursting pressure of an associated low-pressure storage tank.

2. Spray head (1) according to claim 1, wherein the bypass pipe (21) is placed in a valve body (16) of the reversing valve (13).

3. Spray head (1) according to claim 2, wherein the valve body (16) is a seat valve body that can be moved in the axial direction and wherein the bypass pipe (21) is made as a central, axial channel in the valve body (16).

4. Spray head (1) according to claim 3, wherein the valve body (16) is placed on a piston rod (19) having the central, axial channel, and wherein said piston rod (19) is open on its face on an end facing normal jet discharge (7) and has, on the side facing spray discharge (9), a lateral, inlet opening (22) into the channel formed by the bypass pipe (21).

* * * * *